US005588273A

United States Patent [19]

Csagoly

[11] Patent Number: 5,588,273

[45] Date of Patent: Dec. 31, 1996

[54] STRUCTURAL BEAM

[76] Inventor: Paul F. Csagoly, 2519 McMullen Booth Rd., Ste. 510, Clearwater, Fla. 34621

[21] Appl. No.: 384,144

[22] Filed: Feb. 6, 1995

[51] Int. Cl.[6] ..... E04C 3/08

[52] U.S. Cl. ..... 52/634; 52/650.1; 52/690; 52/693; 52/729.1; 52/731.1

[58] Field of Search ..... 52/634–638, 650.1, 52/650.2, 690, 693, 694, 696, 729.1–729.3, 730.6, 731.1, 731.7, 652.1

[56] References Cited

U.S. PATENT DOCUMENTS

| | | | |
|---|---|---|---|
| 114,039 | 4/1871 | Pratt | 52/693 |
| 735,920 | 8/1903 | Visintini | 52/693 X |
| 1,563,077 | 11/1925 | Danforth | 52/634 |
| 1,563,118 | 11/1925 | Tonnelier | 52/634 |
| 1,644,940 | 10/1927 | Moyer . | |
| 1,741,423 | 12/1929 | Lachman | 52/636 |
| 2,002,044 | 5/1935 | Rothenstein . | |
| 2,088,781 | 8/1937 | Folsom | 52/694 X |
| 2,990,038 | 6/1961 | Diamond . | |
| 3,066,394 | 12/1962 | Litzka | 52/636 X |
| 3,283,464 | 11/1966 | Litzka | 52/729.1 X |
| 3,626,653 | 12/1971 | Amirikiaz | 52/690 X |
| 4,348,850 | 9/1982 | Reeder et al. | 52/696 X |
| 4,894,898 | 1/1990 | Walker . | |

FOREIGN PATENT DOCUMENTS

| | | | |
|---|---|---|---|
| 1534158 | 1/1990 | U.S.S.R. . | |
| 0498281 | 1/1939 | United Kingdom | 52/636 |

*Primary Examiner*—Robert Canfield
*Attorney, Agent, or Firm*—Banner & Witcoff, Ltd.

[57] ABSTRACT

A structural beam for use in buildings and other structures, and a process of forming the structural beam. The structural beam exhibits the structural advantages of a truss without the high labor costs normally associated with a truss. The beam includes a top flange, a bottom flange, a web joining the top and bottom flanges, and a plurality of apertures located within the web. Top and bottom chords including neutral axes are defined by a respective flange and longitudinally uninterrupted web portion. A plurality of joining members located in the web between the top and bottom chord transmit loading forces generally along diagonal axes. The diagonal axes of adjacent joining members intersect at panel points which are located substantially along the neutral axis of a respective chord. Haunches provide local structural deepenings of the top and bottom chords in the regions of the panel points to locate critical points a safe distance away from the flow of stresses due to loading. The structural beam is formed by longitudinally cutting through a beam along a repetitive pattern to create upper and lower beam sections. vertically separating the beam sections, and affixing the beam sections together to elongate the height of the web and create a beam-truss.

15 Claims, 7 Drawing Sheets

STRUCTURAL BEAM

FIELD OF THE INVENTION

This invention relates to a structural beam for use in buildings and other structures, and a process of forming the structural beam. More specifically, this invention relates to a structural beam which exhibits the structural advantages of a truss without the usually high labor costs associated therewith.

BACKGROUND OF THE INVENTION

Structural beams have been used in the construction of buildings and other structures for many years. It is well known that many applications of structural beams require the structural beams to support considerably large loads. One measure of expressing structural effectiveness of a beam is its strength-to-weight ratio, however, most solid metal beams do not have a favorable strength-to-weight ratio.

Further, the use of solid beams in many applications, e.g., in between a ceiling and vertically adjacent floor of multi-story buildings, requires additional space between the ceiling and floor to accommodate services such as air ducts, pipes, electrical conduits, and the like. Some builders have attempted to eliminate the need for the additional vertical space and accommodate the services by cutting away sections from the webs of the beams, and subsequently reinforcing the beams around the cut-away sections. However, this practice weakens the beams, requires expensive reinforcing, and does not permit the free relocation of such services.

Trusses have also been used in the construction of buildings and other structures for many years. However, trusses typically are comprised of many distinct pieces and may be labor intensive to assemble. In many cases, the labor cost to assemble a truss renders them impractical for many uses.

Castellated beams have been used to provide increased beam strength over traditional I-beams, channel shaped beams, and T-beams. Castellated beams mainly obtain their increased strength based on the principle that the resistance to loads depends to a great degree on the height of a beam, and that a beam with an increased height results in an increased load-carrying capacity.

Castellated beams are disclosed in U.S. Pat. Nos. 1,644,940, 2,002,044, 2,990,038, and 4,894,898. In these patents, an I-beam or a channel shaped beam is cut longitudinally along its web in a repetitive longitudinal pattern. Once the beam is cut, the beam halves are vertically separated and horizontally shifted one half the width of the pattern so that portions of the beam halves are aligned. The beam halves are then welded together along mating segments. The resulting structural beam includes spaced apertures with connecting segments located between the apertures. The shape of the apertures varies as a function of the shape of the cut.

One example of a prior art castellated beam is shown in FIGS. 1 and 2. In FIG. 1, an I-beam 10 having an upper flange 12, a web 14, and a lower flange 16 is cut longitudinally along its web 14 by a single cut 18 having a repetitive pattern to form two beam halves. The repetitive pattern cut 18 includes: (i) an upper horizontal segment 20, (ii) a downwardly and forwardly angled segment 22, (iii) a lower horizontal segment 24, and (iv) a upwardly and forwardly angled segment 26. The beam halves are then vertically separated and horizontally shifted. Upper and lower horizontal segments 20 and 24 are of equal length, while downwardly and forwardly angled segment 22 and upwardly and forwardly angled segment 26 are of equal length and equal but reversed slope. The beam halves are vertically separated by a distance 28 equal to the vertical spacing between upper horizontal segment 20 and lower horizontal segment 24. The beam halves are horizontally shifted by a distance 30 equal to one half the horizontal distance of the pattern, i.e., the horizontal distance between the beginning of upper horizontal segment 20 and the beginning of lower horizontal segment 24.

As shown in FIG. 2, the beam halves are then welded together along the interfacing horizontal segments 25 of the beam halves, i.e., the lower horizontal segments 24 of the upper beam half and the upper horizontal segments 20 of the lower beam half. The resulting beam structure 10' includes a vertically elongated web 14' with longitudinally spaced hexagonal apertures 34. However, the castellated beam 10' of FIG. 2 and the castellated beams of the aforementioned patents do not behave in a manner similar to a truss.

A tress, which is a structure known to provide exceptional strength, is defined by a geometry where the neutral axes of adjacent diagonals intersect at a common point substantially along the neutral axis of the chord member. Thus, for a structural beam to behave like a truss, the beam structure must transfer forces generally diagonally along connecting segments between top and bottom chords so that the neutral axes of adjacent connecting diagonal segments intersect at a point substantially along the neutral axis of a respective chord.

While the connecting portions of the FIG. 2 beam structure may possibly transfer forces diagonally, adjacent diagonal transfer axes 36, each approximated to intercept segment 25 at its center point and to be parallel to segment 26, intersect at a point 40 well outside the beam 10', and clearly, not substantially along the neutral axis 42 of the beam chord. Therefore, beam 10' can never fully behave as a truss and obtain the advantages associated therewith.

FIGS. 3 and 4 illustrate a beam structure as disclosed in Soviet Union Patent No. 1534-158. As depicted in FIG. 3, an I-beam 50 including upper and lower flanges 51 and 53 and a web 52, is cut along its web 52 in a longitudinally repeated trapezoidal-like pattern 54. The pattern of cut 54 includes: (i) a lower horizontal segment 56, (ii) an upwardly and rearwardly angled segment 58, (iii) an upper horizontal segment 60, and (iv) a downwardly and rearwardly angled segment 62. Cut 54 creates an upper beam half 63 having an upper chord 64 which includes upper flange 51 and the web portion which extends down to the longitudinal axis defined by upper horizontal segment 60. Similarly, a lower beam half 65 is created having a lower chord 66 which includes lower flange 53 and the web portion which extends up to the longitudinal axis defined by lower horizontal segment 56.

The resulting beam halves 63 and 65 include a respective chord 64 or 66 and trapezoidal shaped projections extending from the ends of chords 64 and 66. The trapezoidal shaped projections of upper beam half 63 are defined by an upwardly and rearwardly angled segment 58, a downwardly and rearwardly angled segment 62, a lower horizontal segment 56, and by a base at the bottom of upper chord 64 between adjacent upper horizontal segments 60. The trapezoidal shaped projections of lower beam half 65 are defined by an upwardly and rearwardly angled segment 58, a downwardly and rearwardly angled segment 62, an upper horizontal segment 60, and by a base at the top of lower chord 66 between adjacent lower horizontal segments 56.

Secondary cuts 70 are made in the trapezoidal projections to remove triangular sections 71 and to form forked sections 72 and 74. The ends of the forked sections 72 and 74 are parallel to the longitudinal axis of beam 50. As shown in FIG. 4, the bottom ends of forked sections 72 of upper beam half 63 butt against and are welded to forked sections 74 of lower beam half 65 along weld lines 76. The resulting beam 50' comprises diagonal joining members 78 formed from forked sections 72 and 74, and triangular shaped apertures 80 between adjacent diagonal joining members 78 and the inner extremities of chords 64 and 66.

However, structural beam 50' may be deficient in that stress concentrations can form dangerously close to various critical points at the intersection of chords and diagonals causing yield, instability or fatigue cracking which may precipitate the failure of the structure. A detailed view of adjacent diagonals 78 and their respective chord 64 is shown in FIG. 5. Point 82 is the panel point where the neutral axis 84*a* and 84*b* of diagonals 78*a* and 78*b* intersect, which may also fall along the neutral axis 86 of chord 64. Critical points 88, 89, and 90 exist where the edges of diagonals 78*a* and 78*b* meet chord 64.

While the structural deficiencies of beam 50' at critical points 88, 89, and 90 can be illustrated by various different stress distribution scenarios, only a single scenario is depicted herein. A single right-hand-side compressive force 92 would be resisted by: (i) a force 93 along neutral axis 86 of chord 64, (ii) a compressive force 94 along the neutral axis 84*a* of diagonal 78*a*, and (iii) a tensile force 95 along the neutral axis 84*b* of diagonal 78*b*. The resulting natural flow of forces, i.e. stress resultants from the diagonals 78*a* and 78*b* will approximately follow lines 96 and 97. As illustrated, the flows of stress resultants are located a short distance 98 from critical point 89 and a short distance 99 from critical point 90, causing the stresses in the vicinity of critical points 89 and 90 to be substantially increased. The location and magnitude of stress concentrations with respect to critical points 88, 89, and 90, prevent beam 50' from being used in other than primarily decorative applications.

There is a need, therefore, for a structural beam that will not only provide enhanced strength by increasing the height of the beam, but will also behave as a truss and reduce stress concentrations around critical points adjacent the panel points.

SUMMARY OF THE INVENTION

It is therefore an object of the present invention to provide a structural beam for use in buildings and other structures which structurally behaves like trusses, free of critical stress concentrations and which is not labor intensive to produce.

It is another object of the invention to provide a process for forming a structural beam in which haunches are inherently formed adjacent the beam chords when the beam is longitudinally cut through its web.

More specifically, it is an object of the invention to provide a structural beam which includes a top flange, a bottom flange, a web joining the top and bottom flanges, and a plurality of apertures located within the web. Top and bottom chords having neutral axes are defined by a respective flange and longitudinally uninterrupted web portion. A plurality of joining members are located in the web between the top and bottom chord and transmit compressive and tensile forces generally along diagonal axes. The diagonal axes of adjacent joining members intersect at panel points which are located substantially along the neutral axis of a respective chord. Additionally, haunches provide local structural deepenings of the top and bottom chords in the regions of the panel points.

These and other objects are achieved by the present invention which, according to one aspect, provides a structural beam for use in a beam-truss. The structural beam includes a longitudinal axis, a flange, a web, and a plurality of projections. The web is generally perpendicular to the flange in cross-section and includes an edge distal from said flange having a pattern which is longitudinally repeated along the structural beam. The edge further having a plurality of first longitudinal edge segments defining a longitudinal chord boundary axis substantially parallel to the longitudinal axis. The projections are longitudinally spaced and extend from the chord boundary axis away from the flange. Each projection includes a base, side edges, and a plurality of widths defined as the longitudinal distance between the side edges of the projection. Each projection includes a first width at its base located along the chord boundary axis, a second width at a first distance spaced from the chord boundary axis, and a third width at a second distance spaced from the chord boundary axis. The second distance is larger than the first distance, and the second width is smaller than the first and third widths.

In another aspect, the invention provides a process for forming a structural beam. The process includes providing a beam having an upper flange, a lower flange and a web connecting the upper flange and the lower flange. The beam is divided into upper and lower beam sections by repetitively cutting the web in a longitudinal pattern. Cutting the beam in a longitudinal pattern includes the sequential cutting steps of the following segments: a lower horizontal segment, a first forwardly and upwardly extending segment, a rearwardly and upwardly extending segment, a second forwardly and upwardly extending segment, an upper horizontal segment, a first forwardly and downwardly extending segment, a rearwardly and downwardly extending segment, and a second forwardly and downwardly extending segment. The process further includes the steps of separating the beam sections and attaching the beam sections together. These and other objects and features of the invention will be apparent upon consideration of the following detailed description of preferred embodiments thereof, presented in connection with the following drawings in which like reference numerals identify like elements throughout.

DETAILED DESCRIPTION

Figure 1:
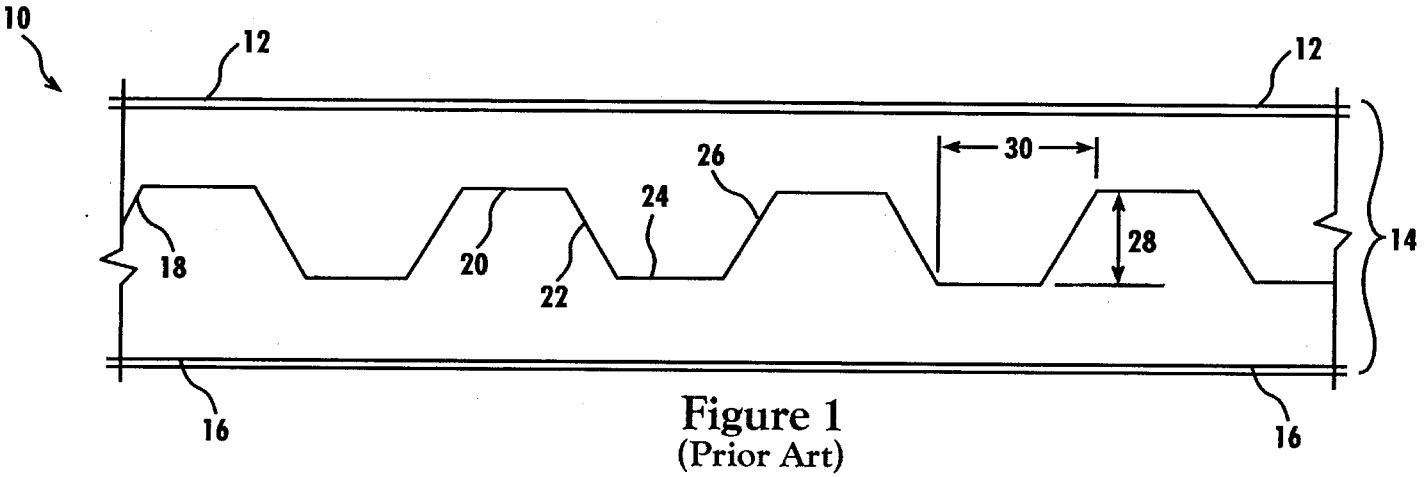
Figure 1 (Prior Art)
FIG. 1 is an elevational view of a longitudinally cut I-beam for forming a prior art castellated beam.
Figure 2:
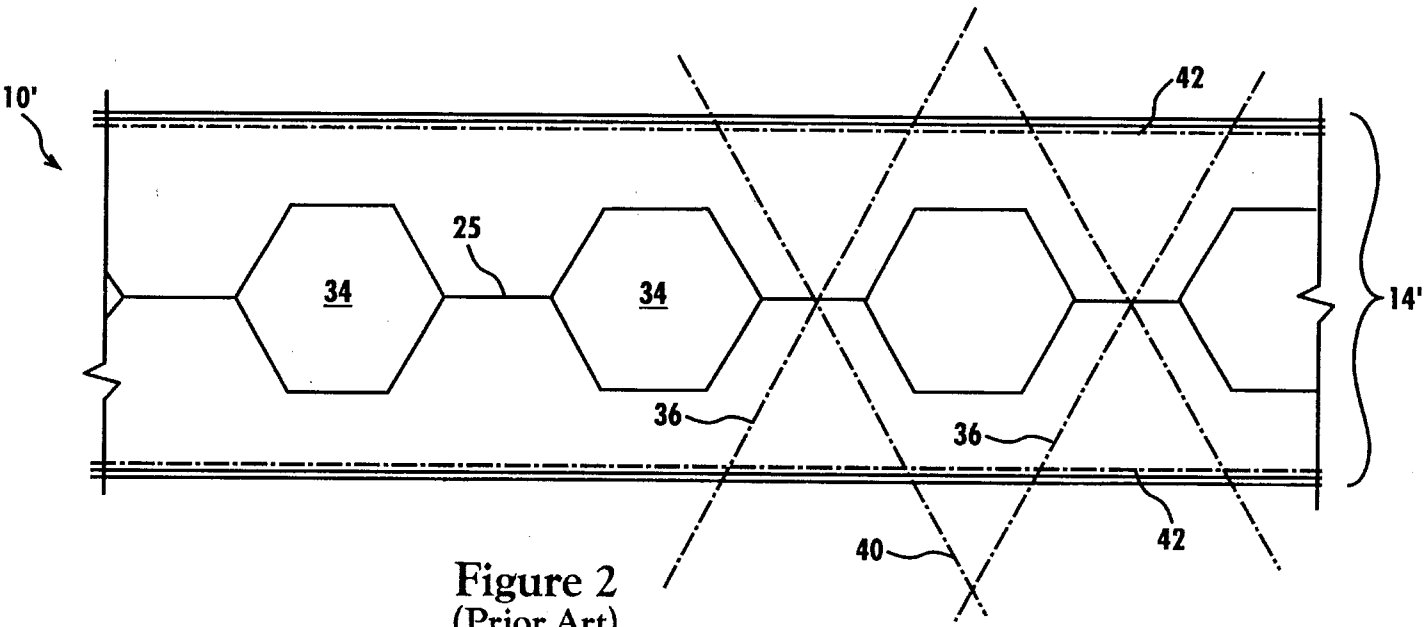
Figure 2 (Prior Art)
FIG. 2 is an elevational view of prior art castellated beam formed from the cut I-beam of FIG. 1.
Figure 3:
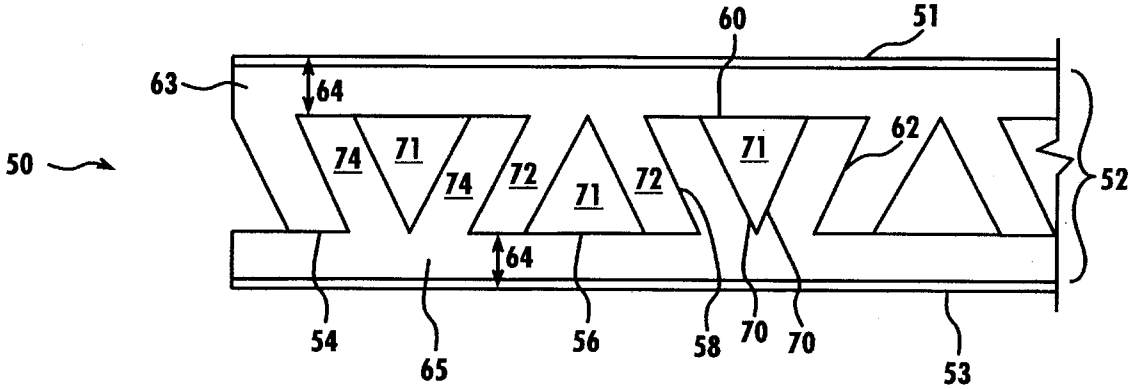
Figure 3 (Prior Art)
FIG. 3 is an elevational view of a longitudinally cut I-beam for forming a second prior art beam.
Figure 4:
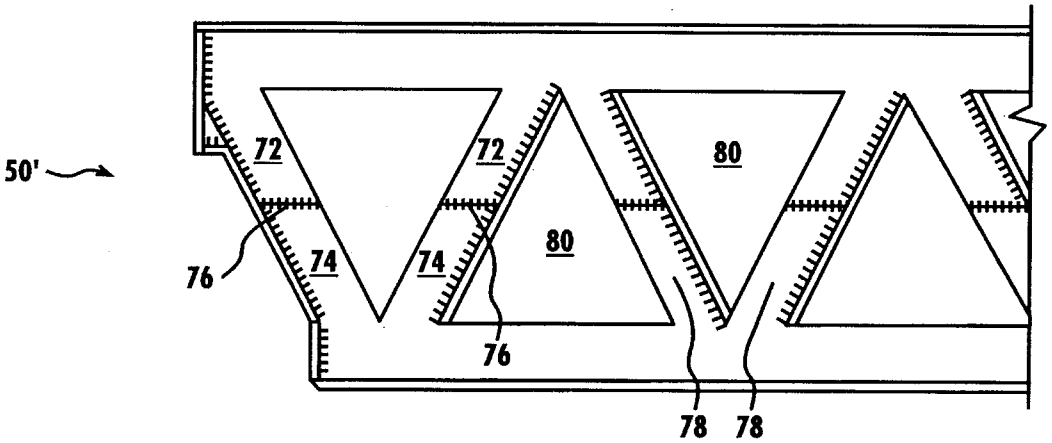
Figure 4 (Prior Art)
FIG. 4 is an elevational view of the prior art beam formed from the cut I-beam of FIG. 3.

Referring to FIGS. 6–12, reference numeral 100 generally designates a structural beam-truss embodying the present invention. As depicted in FIGS. 6–12, beam-truss 100 is comprised from a metal I-beam 102 with a top flange 104, a bottom flange 106, and a web 108 connecting top flange 104 to bottom flange 106. If desired, another channel beam shape having a web could be used in lieu of I-beam 102. While steel is the preferred beam material, aluminum or any other suitable metal or composite material suitable for a structural beam-truss, could be used.

Figure 6:
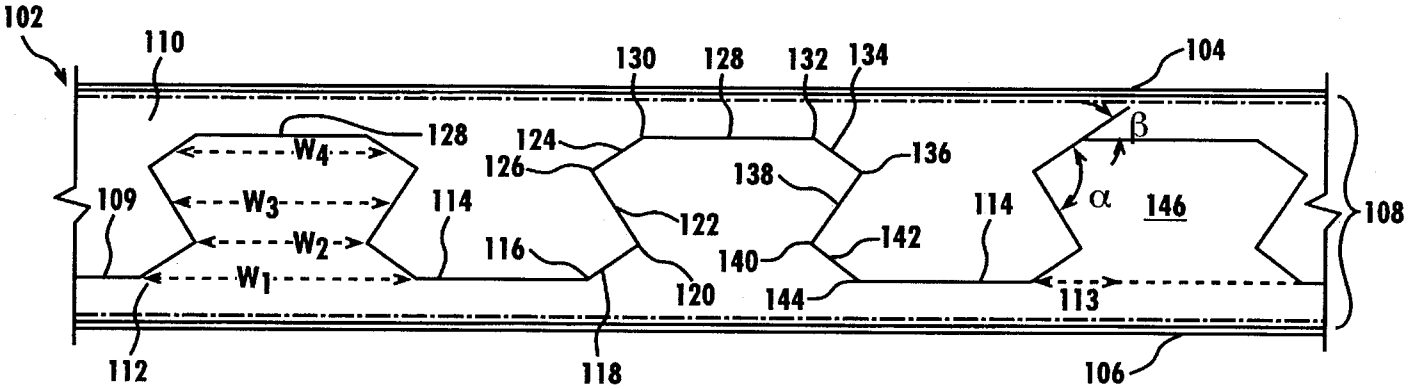
FIG. 6 is an elevational view of a longitudinally cut I-beam for forming the beam-truss of the present invention.

As shown in FIG. 6, beam 102 is cut along a repetitive longitudinal zigzag-type pattern 109 to divide beam 102 into an upper beam section 110 and a lower beam section 112. As will be evident from the description of beam-truss 100 hereinafter, the repetitive pattern facilitates the forming of a beam-truss with enhanced strength in various critical areas.

The pattern 109 which is longitudinally repeated includes eight segments. In a consecutive order, the first or "lower horizontal" segment 114 is substantially parallel to the longitudinal axis of beam 102. A second segment 118 or "first forwardly and upwardly extending" segment, begins at the end 116 of lower horizontal segment 114, and extends forwardly and upwardly toward upper flange 104. A third segment 122 or "rearwardly and upwardly extending" segment, begins at the end 120 of first forwardly and upwardly extending segment 118, and extends rearwardly and upwardly. A fourth segment 124 or a "second forwardly and upwardly extending" segment, begins at the end 126 of rearwardly and upwardly extending segment 122, and extends forwardly and upwardly. First and second forwardly and upwardly extending segments 118 and 124 are of equal length and are parallel to each other for the subsequent mating and attachment of separated beam sections 110 and 112.

A fifth or upper horizontal segment 128, begins at the end 130 of second forwardly and upwardly extending segment, and extends parallel to the longitudinal axis of beam 102. A sixth segment 134 or "first forwardly and downwardly extending" segment, begins at the end 132 of upper horizontal segment 128, and extends forwardly and downwardly toward lower flange 106. A seventh or "rearwardly and downwardly extending" segment 138 begins at the end of 136 first forwardly and downwardly extending segment 134, and extends rearwardly and downwardly. An eighth segment 142 or "second forwardly and downwardly extending" segment, begins at the end 140 of rearwardly and downwardly extending segment 138, and extends forwardly and downwardly. The end 144 of second forwardly and downwardly extending segment 142 is also the beginning of the lower horizontal segment 114 of the adjacent pattern. First and second forwardly and downwardly extending segments 134 and 142 are of equal length and are substantially parallel to each other for the subsequent mating and attachment of separated beam sections 110 and 112.

It should be noted that the reference to lower horizontal segment 114 as the "first" segment is arbitrary, and that any of the segments could be referred to as the "first" segment. Further, while upwardly and rearwardly extending segment 122 may be perpendicular to both upwardly and forwardly extending segments 118 and 124, such angular orientation is not necessary, as any angular relationship could be used. Similarly, while downwardly and rearwardly extending segment 138 may be perpendicular to both downwardly and forwardly extending segments 134 and 142, such angular orientation is not necessary, as any angular relationship could be used.

Further, in construction applications, e.g. building floors, a preferred embodiment includes an angular displacement $\beta$ of 15.0°, i.e., the angle between second forwardly and upwardly segment 124 and upper horizontal segment 128, and an angular displacement $\alpha$ of 72.5°, i.e., the angle between rearwardly and upwardly extending segment 122 and second forwardly and upwardly extending segment 124. In industrial applications, e.g., bridges, angular displacements $\beta$ and $\alpha$ would preferably be larger. However, in both types of applications, it is recognized that many different angular displacement values could be used.

The cut pattern 109 is repeated along web 108 until beam 102 is divided into upper and lower beam halves or sections 110 and 112. The cutting can be done by any cutting device used for such a task, of which the most obvious is a flame cutter.

Each beam section 110 and 112 is in actuality a beam in itself including a flange 104 or 106 and a web portion extending perpendicular to the flange in cross-section. As beam sections 110 and 112 are similar in shape and size, a detailed description of one beam section, e.g., beam section 112, will be provided herein. The web of each section 112 includes an edge which is distal from flange 106, and created by the pattern of cut 109. Beam section 112 further includes a longitudinal chord boundary axis 113 defined by the edge created by lower horizontal segment 114. Beam section 112 further includes a plurality of longitudinally spaced projections 146 extending from chord boundary axis 113 away from flange 106.

Each projection 146 includes a base located along chord boundary axis 113, a distal edge or tip, opposite its base, formed by upper horizontal segment 128, and side edges defined by the side segments 118, 112, 124, 134, 138, and 142 between horizontal segments 114 and 128. The width of projection 146 at a given point is defined as the longitudinal distance between the side edges of projection 146. As shown in FIG. 6, the width $w_1$ of projection 146 at its base is larger than the width $w_2$ of projection 146 at points 120 and 140. The width, e.g., $w_3$, of projection 146 increases from width $w_2$ until end points 126 and 136 are reached. The width, e.g., $w_4$, of projection 146 then decreases until the distal edge formed by upper horizontal segment 128 is reached. This arrangement inherently forms a diagonally oriented connecting or joining members and haunches, i.e., local deepenings of the chord.

Figure 7:
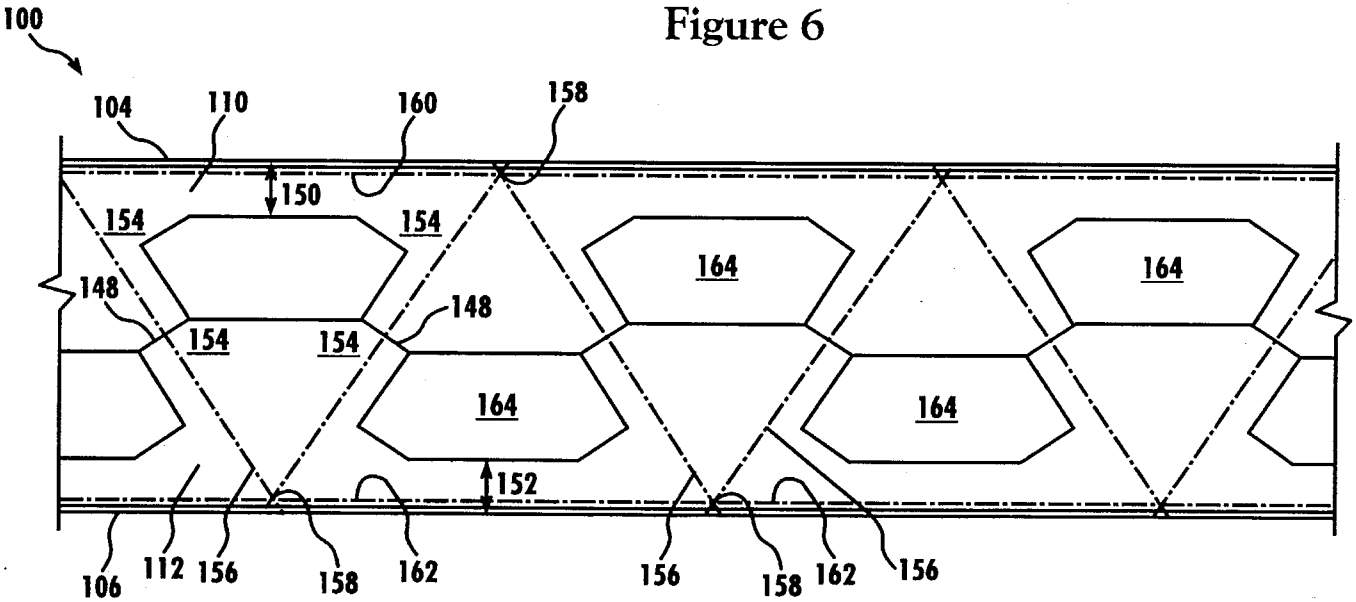
FIG. 7 is an elevational view of the beam-truss of the present invention formed from the cut beam of FIG. 6.

The two beam sections 110 and 112 are vertically displaced, without a resulting longitudinal displacement, so that the edges of lower beam section 112 formed by segments 124 and 134 are in alignment with the edges of upper beam section 110 formed by segments 118 and 142. As depicted in FIG. 7, the two beam sections 110 and 112 are welded together along interfacing or weld lines 148 so that the two beam sections 110 and 112 become beam-truss 100. If desired, in lieu of welding, beam sections 110 and 112 can be attached by mechanical connectors or adhesives.

This configuration creates a beam-truss 100. A beam-truss, as defined herein, is a beam with discontinuity in its web wherein the remaining material in the web permits the inscription of a viable truss configuration. The beam-truss includes top and bottom chords and connecting or joining members between the top and bottom chords. The top and bottom chords each have a neutral axis. The connecting members generally transfer forces between the top and bottom chords along diagonal axes. The diagonal axes of adjacent connecting intersect at a panel point which lies on, or approximately lies on, the neutral axis of a respective chord. In sum, a beam-truss is a single beam structure which generally structurally emulates a truss.

Beam-truss 100 exhibits beneficial structural characteristics of a truss, i.e., a structure composed of adjoining triangles which are formed by straight members. As in a truss, beam-truss 100 includes top and bottom chords 150 and 152, i.e., the top or bottom members of the truss, and web joining or connecting members 154, i.e., the members connecting the top and bottom chords. Forces are generally transferred between the top and bottom chords 150 and 152 by connecting members 154 along diagonal axes 156. As evident from FIGS. 8–11, diagonal axes 156 are preferably also the neutral axes of the connecting members 154. The diagonal axes 156 of adjacent connecting members 154 intersect substantially at a panel point 158 which intersects, or substantially intersects the neutral axis 160 or 162 of a respective chord 150 or 152.

Beam-truss 100 is also advantageous because it is lighter than a solid beam of the same web height. Beam-truss 100 includes apertures 164 which are inherently formed by the cutting and separation of beam 102. Apertures 164 in the FIG. 7 beam-truss 100, i.e., the beam-truss without secondary cuts, are six sided having six interior angles.

Figure 8:
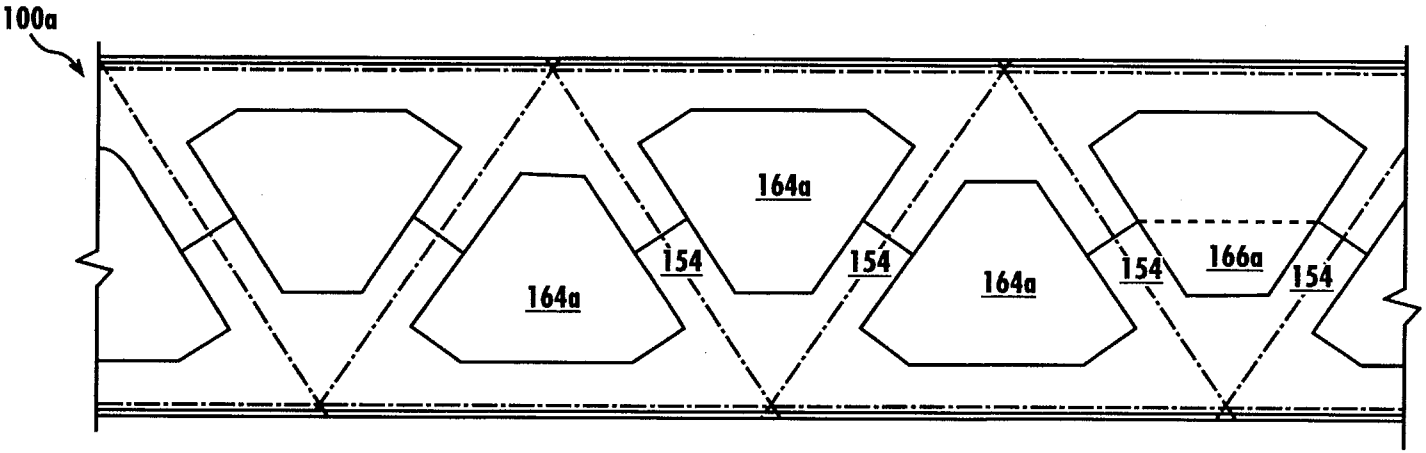
FIG. 8 depicts the beam-truss of FIG. 7 with a first example of secondary cuts made in the beam halves.
Figure 9:
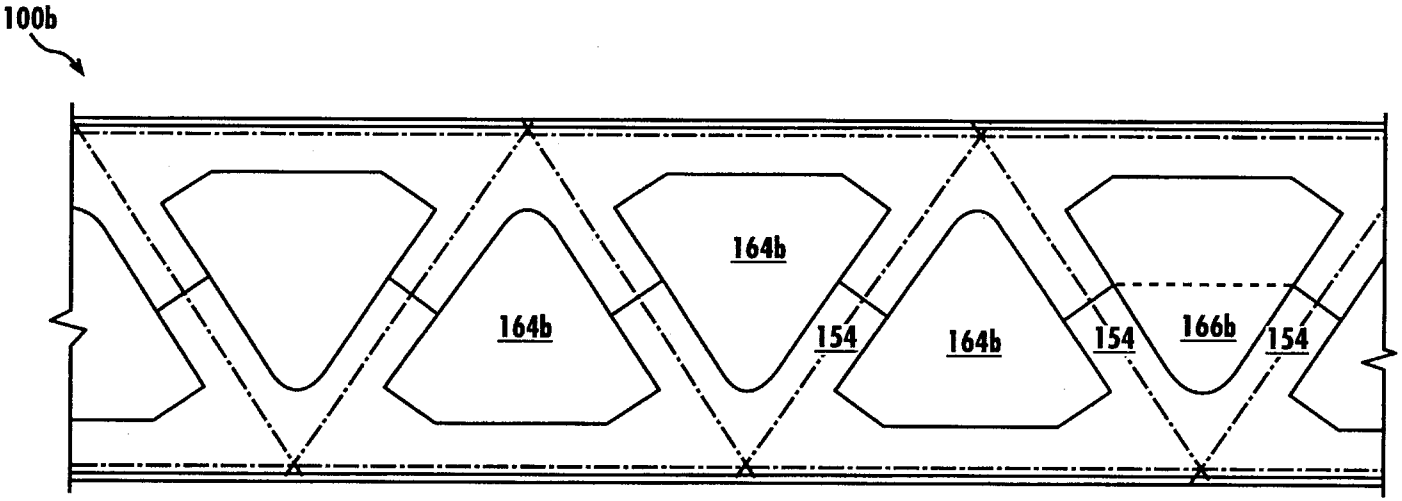
FIG. 9 depicts the beam-truss of FIG. 7 with a second example of secondary cuts made in the beam halves.
Figure 10:
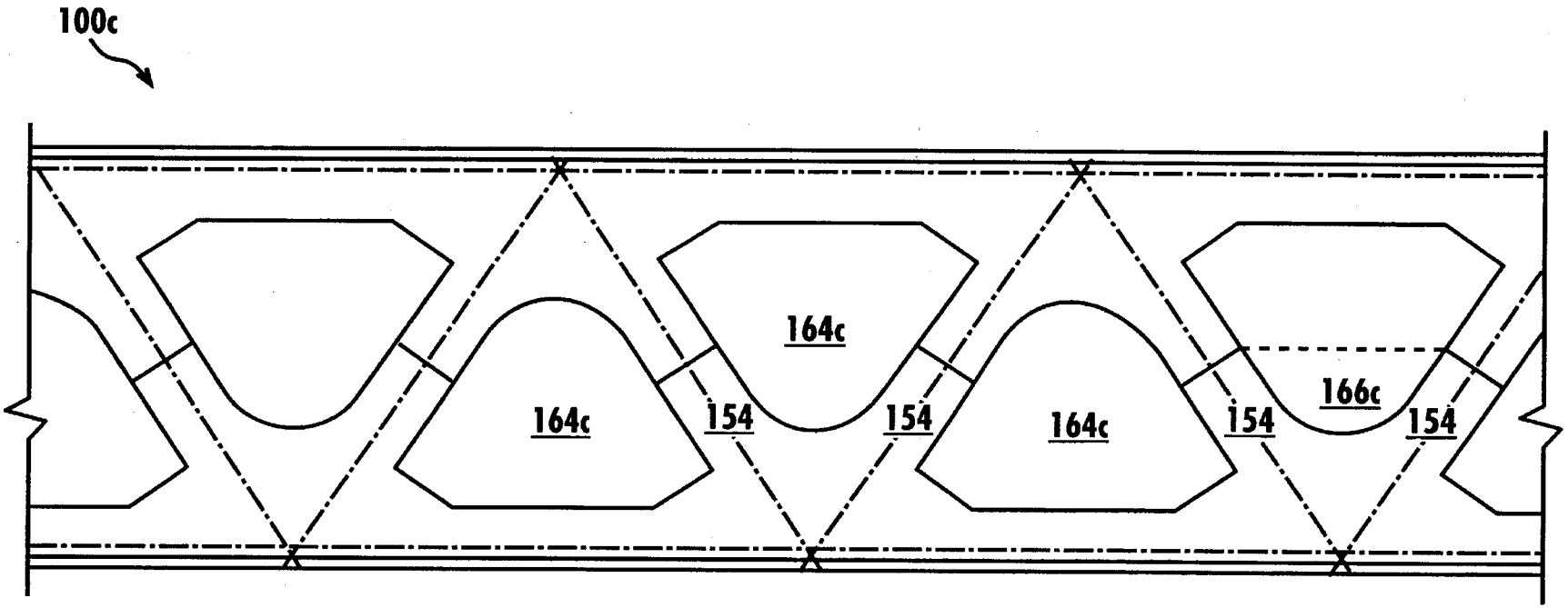
FIG. 10 depicts the beam-truss of FIG. 7 with a third example of secondary cuts made in the beam halves.

If desired, secondary cuts **166*a*–166*c* may be made in the web, as shown in FIGS. 8–10. Secondary cuts 166 enlarge apertures 164*a*–164*c* and provide a larger passageway through beam-truss 100*a*–100*c* to permit the passage of larger or irregularly shaped air ducts, pipes, electrical conduits, and the like. Further, secondary cuts 166 enhance the aesthetic appearance of the beam-truss 100, which may be important for use in structures where beam-truss 100 is exposed for viewing. Additionally, secondary cuts 166 provide a reduction in the weight of beam-truss 100 without significantly affecting the strength of beam-truss 100, and the removed metal could be recycled for a cost savings. If desired, secondary cuts 166** can be made in selected apertures and need not be made on all apertures.

Secondary cuts **166*a*–166*c* can be made in the projections of FIGS. 6 and 7, to form forked ends as shown in FIGS 8–10, each defined by adjacent joining members 154, i.e., the forked end segments or prong extensions, and a concave region between the joining members. Once the beam halves are secondarily cut and joined, the space between the joining members help define the apertures 164*a*–164*c* shown in FIGS. 8–10**.

As shown in FIGS. 8–10, secondary cuts **166*a*–166*c* can be shaped to yield apertures 164*a*–164*c* which are generally diamond shaped. The beam-truss 100*a* in FIG. 8 includes a trapezoidal shaped secondary cut 166*a***, yielding an aperture having six sides and six interior angles.

Secondary cuts **166*b*–166*c* in FIGS. 9–10 differ from secondary cut 166*a* in that the removed secondary piece is triangular shaped, with the apex of the triangle adjacent the juncture of joining members 154 being rounded-off. FIG. 9 differs from FIG. 10 in that the radius of the rounded-off section in FIG. 9 is small than in FIG. 10. Apertures 164*b*–164*c*** are generally diamond shaped including five sides, four interior angles and a curved base section.

Beam-truss 100 provides numerous strength advantages, mainly because a haunch 170 is inherently formed by the pattern of the cut 109. Haunch 170 provides a local deepening of chord 150 to strengthen beam-truss 100 and shift critical points 172-177 between: (i) the diagonals connecting members 154 and haunch 170, and (ii) between haunch 170 and chord 150, farther away from stress concentration paths.

Figure 5:
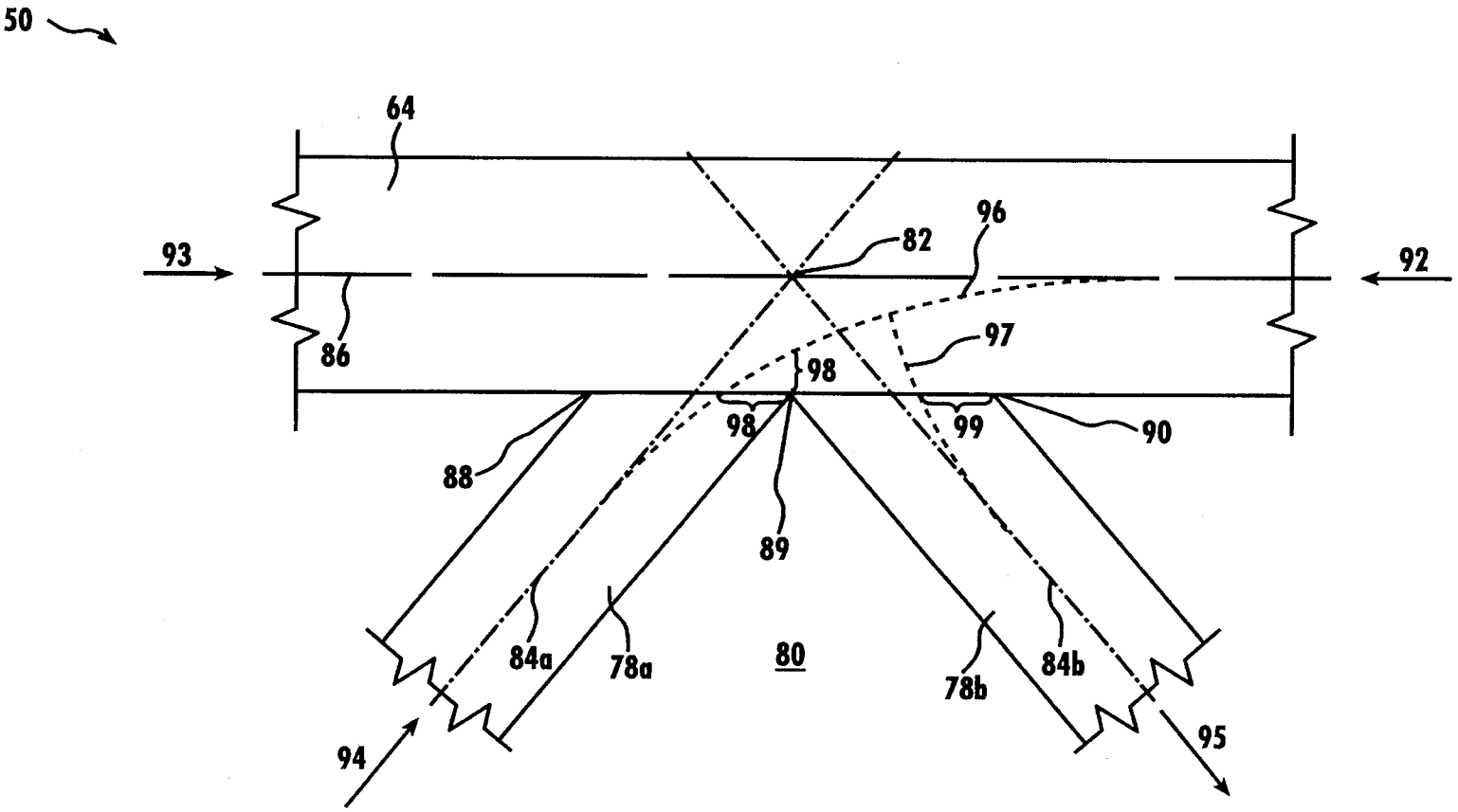
Figure 5 (Prior Art)
FIG. 5 is a detailed elevational view of the prior art beam of FIG. 4, illustrating the distribution of stresses in the region adjacent a panel point.
Figure 11:
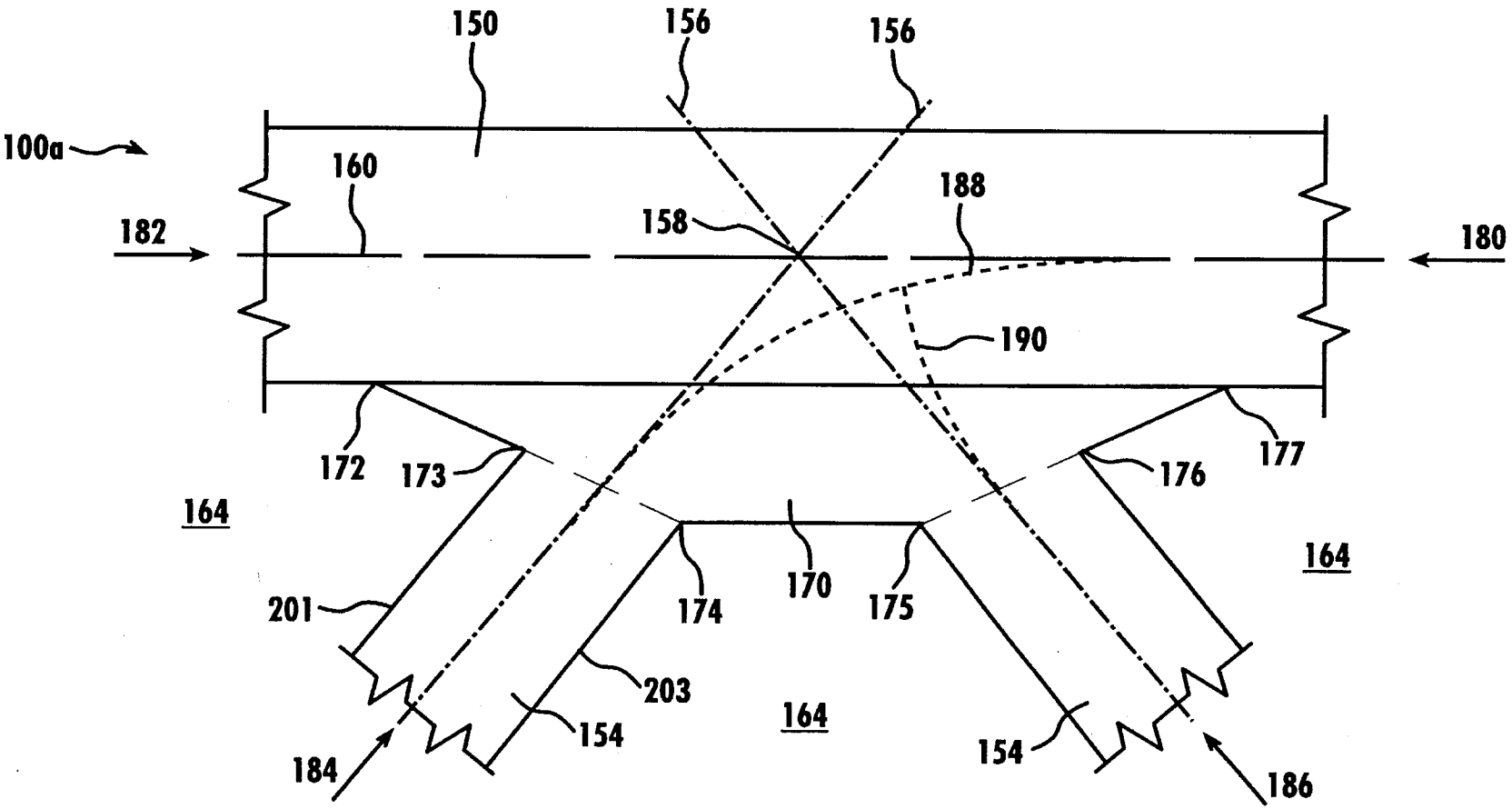
FIG. 11 is a detailed elevational view of the beam-truss of the present invention, as shown in FIG. 8, illustrating the approximate flow of forces in the region adjacent to a panel point.

FIG. 11 illustrates a detailed view of a beam-truss of the present invention, e.g., beam-truss **100*b*, showing adjacent connecting members 154, their respective chord 150, and haunch 170, being subjected to a single right-hand-side compressive force 180, identical to force 92 in prior art FIG. 5. Compressive force 180 is resisted by: (i) a force 182 along neutral axis 160 of chord 150, (ii) a compressive force 184 along the axis 156 of connecting member 154, and (iii) a tensile force 186 along the axis 156 of connecting member 154. The resulting natural flow of forces will follow lines 188 and 190. As evident from FIG. 11, the flows of stresses are farther away from critical points 172–177, than from critical points 89 and 90 of the prior art FIG. 5 beam. It is also evident that each connecting member includes a pair of opposing side edges 201, 203** each of which terminates at a location spaced from both the top and bottom chords.

It is to be understood that the disclosed embodiments are merely illustrative of the principles of the present invention which could be implemented by other types of structures which would be readily apparent to those skilled in the art. For example, while beam-truss 100 is shown as an I-beam, a beam-truss could be a T-beam or a channel shaped beam. Accordingly, the scope of the present invention is to be determined in accordance with the appended claims.

What is claimed is:

1. A structural beam comprising:

a top flange, a bottom flange, a substantially planar web joining the top and bottom flanges;

a plurality of apertures located within the web;

a top chord, said top chord including said top flange and a longitudinally uninterrupted web portion, said top chord further including a neutral axis;

a bottom chord, said bottom chord including said bottom flange and a longitudinally uninterrupted web portion, said bottom chord further including a neutral axis;

a plurality of joining members located in said web between the top and bottom chord;

each said joining member adapted to transmit loading forces along a diagonal axis, said diagonal axes of adjacent joining members intersecting at panel points, said panel points located substantially along the neutral axis of a respective chord; and haunches located in the plane of the web providing local structural deepenings of the top and bottom chords in the regions of the panel points;

wherein said haunches are substantially trapezoidal-shaped, each substantially trapezoidal-shaped haunch having a first side located proximate its respective chord and a second side, parallel with the first side, located distal from its respective chord, said first side being longer than said second side and, wherein each joining member includes a pair of opposing side edges, each said side edge terminating at a location spaced from both said top and bottom chords.

2. The structural beam of claim 1, wherein each said joining member being attached at its ends to a respective haunch.

3. The structural beam of claim 1, wherein said joining members include connected upper and lower joining member portions, said upper and lower joining member portions fixedly attached to each other along a seam angularly displaced from said longitudinal axis.

4. The structural beam of claim 1, wherein said plurality apertures include a plurality of upper and lower apertures which are alternately longitudinally spaced.

5. The structural beam of claim 1, wherein said joining members are web supports oriented diagonally between the top and bottom chords.

6. A structural beam having a longitudinal axis, for use in a beam-truss, said structural beam comprising:

a flange;

a web having an end connected to said flange, said web being generally perpendicular to said flange in cross-section;

said web including an edge distal from said flange, said edge including a pattern which is longitudinally repeated along the structural beam; said edge including a plurality of first longitudinal edge segments defining a longitudinal chord boundary axis substantially parallel to said longitudinal axis; said web further including longitudinally spaced projections extending from said chord boundary axis away from said flange;

each said projection having a base, side edges, and a plurality of widths, each width being defined as the longitudinal distance between the side edges of the projection; each said projection having a first width at its base located along the chord boundary axis, a second width at a first distance spaced from said chord boundary axis, and a third width at a second distance spaced from said chord boundary axis; said second distance being larger than said first distance; said second width being smaller than said first width and said third width.

7. The structural beam of claim 6, wherein each said projection further having a distal longitudinal edge substantially parallel to said longitudinal chord boundary axis, each said distal longitudinal edge being connected to its base, along each side, by a plurality of angularly oriented side edge segments.

8. The structural beam of claim 7, wherein said plurality of angularly oriented side edge segments, include first, second, and third angularly oriented side edge segments, said first and third angularly oriented side edge segments being substantially parallel to each other.

9. The structural beam of claim 6, wherein each said projection further having a forked end distally spaced from said longitudinal chord boundary axis, said forked end including a pair of prong extensions.

10. The structural beam of claim 9, wherein said forked end further including a concave region between the pair of prong extensions.

11. A structural beam comprising:

a top flange, a bottom flange, a web joining the top and bottom flanges;

a plurality of apertures located within the web;

a top chord, said top chord including said top flange and a longitudinally uninterrupted web portion, said top chord further including a neutral axis;

a bottom chord, said bottom chord including said bottom flange and a longitudinally uninterrupted web portion, said bottom chord further including a neutral axis;

a plurality of joining members located in said web between the top and bottom chord;

each said joining member adapted to transmit loading forces along a diagonal axis, said diagonal axes of adjacent joining members intersecting at panel points, said panel points located substantially along the neutral axis of a respective chord; and haunches providing local structural deepenings of the top and bottom chords in the regions of the panel points;

wherein said joining members include connected upper and lower joining member portions, said upper and lower joining member portions fixedly attached to each other along a seam angularly displaced from said longitudinal axis.

12. The structural beam of claim 11, wherein said haunches are substantially trapezoidal shaped.

13. The structural beam of claim 11, wherein each said joining member being attached at its ends to a respective haunch.

14. The structural beam of claim 11, wherein said plurality apertures include a plurality of upper and lower apertures which are alternately longitudinally spaced.

15. The structural beam of claim 11, wherein said joining members are web supports oriented diagonally between the top and bottom chords.

* * * * *